US010850418B2

(12) United States Patent
Urrutia Nebreda et al.

(10) Patent No.: US 10,850,418 B2
(45) Date of Patent: Dec. 1, 2020

(54) CUTTER CALIBRATION

(71) Applicant: Hewlett-Packard Development Company, L.P., Houston, TX (US)

(72) Inventors: Martin Urrutia Nebreda, Sant Cugat del Valles (ES); Isabel Sanz Ananos, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 43 days.

(21) Appl. No.: 15/760,516

(22) PCT Filed: Dec. 21, 2015

(86) PCT No.: PCT/EP2015/080871
§ 371 (c)(1),
(2) Date: Mar. 15, 2018

(87) PCT Pub. No.: WO2017/108084
PCT Pub. Date: Jun. 29, 2017

(65) Prior Publication Data

US 2018/0281218 A1 Oct. 4, 2018

(51) Int. Cl.
*B26D 5/00* (2006.01)
*B26F 1/38* (2006.01)
(Continued)

(52) U.S. Cl.
CPC ..... *B26D 5/007* (2013.01); *B26D 1/225* (2013.01); *B26D 5/00* (2013.01); *B26F 1/3813* (2013.01); *B41J 11/66* (2013.01)

(58) Field of Classification Search
CPC ... Y10T 83/141; Y10T 83/145; Y10T 83/148; Y10T 83/178; Y10T 83/515; Y10T 83/538; Y10T 83/0495; Y10T 83/162; Y10T 83/173; Y10T 83/175; Y10T 83/853; Y10T 83/855; Y10T 83/856; Y10T 83/857; Y10T 83/858; B26D 5/007; B26D 1/04; B26D 1/045; B26D 1/06; B26D 1/065; B26D 1/10; B26D 1/105; B26D 1/11;
(Continued)

(56) References Cited

U.S. PATENT DOCUMENTS 6,276,586 B1 8/2001 Yeo et al.
8,866,861 B2 10/2014 Schuh et al.
(Continued)

FOREIGN PATENT DOCUMENTS

EP 2821869 1/2015
JP 2010278768 12/2010
WO WO-2014130747 8/2014
WO WO-2014130747 A1 * 8/2014 ..... B26D 5/005

OTHER PUBLICATIONS

Murtomaa, M. et al., "Triboelectrification of paper in the offset printing process", Journal of Electrostatics, Jun. 2006.

*Primary Examiner* — Evan H MacFarlane
(74) *Attorney, Agent, or Firm* — HP Inc. Patent Department

(57) ABSTRACT

A cutter is positioned at a cutting position according to a virtual coordinate system. Media is cut at the cutting position using the cutter to create a cut. The actual location of the cut in the media is detected and the virtual coordinate system is calibrated based on an offset between the cutting position and the actual cut location.

11 Claims, 4 Drawing Sheets

(51) Int. Cl.
*B26D 1/22* (2006.01)
*B41J 11/66* (2006.01)

(58) Field of Classification Search
CPC .. B26D 1/115; B26D 1/12–245; B26D 5/005; B26D 5/30; B26D 5/32; B26D 5/34; B26D 2007/2657; B26D 2007/2678; B26D 1/02; B26D 1/025; B26D 1/03; B26D 1/035; B26D 3/12; B26D 7/26; B26D 7/2628; B26D 7/2635; B26D 15/06; B26D 15/08; B26D 36/0091; G05B 2219/45038; G05B 2219/45044; G05B 2219/45036; G05B 2219/45037; G05B 2219/45039; G05B 2219/45041; G05B 19/18; G05B 19/19; G05B 19/402; G05B 19/404; B26F 1/3813; B26F 1/382; B26F 1/3826; B26F 1/3806; B41J 11/66; B41J 11/663; B41J 11/666; B41J 11/68; B41J 11/70; B41J 11/706; B23Q 17/2233–2275; B23D 1/02; B23D 1/04; B23D 1/06; B23D 15/06; B23D 15/08; B23D 36/0091
USPC .... 83/72–74, 359, 368, 76.8, 33, 76.1, 76.6, 83/76.7, 522.15, 522.16, 522.17, 522.18, 83/522.19
See application file for complete search history.

(56) References Cited

U.S. PATENT DOCUMENTS

| | | | | |
|---|---|---|---|---|
| 9,056,400 | B2 | 6/2015 | Carson et al. | |
| 2001/0047702 | A1* | 12/2001 | Tychsen | B27B 5/06 83/13 |
| 2003/0145750 | A1* | 8/2003 | Chang | B26D 5/32 101/484 |
| 2007/0215248 | A1* | 9/2007 | Carpentier | B23Q 15/02 144/382 |
| 2008/0087148 | A1* | 4/2008 | DePoi | B65H 23/046 83/13 |
| 2009/0217793 | A1* | 9/2009 | Spillner | B26F 3/004 83/289 |
| 2009/0250445 | A1* | 10/2009 | Yamaguchi | B23K 10/006 219/121.72 |
| 2009/0255387 | A1* | 10/2009 | Pelletier | B26D 5/32 83/13 |
| 2013/0055540 | A1* | 3/2013 | Schneider | B24B 9/148 29/284 |
| 2014/0121085 | A1* | 5/2014 | Kwarta | B26D 7/2628 483/10 |
| 2016/0026168 | A1* | 1/2016 | Crystal | B26D 5/005 700/114 |
| 2016/0136843 | A1* | 5/2016 | Katoh | B28D 1/044 125/14 |

* cited by examiner

CUTTER CALIBRATION

BACKGROUND

Cutting machines can include cutters that are positioned manually or automatically. In the case of manually positioned cutters, calibration of the cutter location is commonly done by an iterative process with several readjustments made until the cutter is at the target position. Cutting machines incorporating automatically positioned cutters can be calibrated with mechanical alignment mechanisms or a feedback based calibration. Feedback based calibration may involve adjusting a cutter position control system by determining the actual position of the cutter, which can present difficulties.

BRIEF DESCRIPTION OF THE DRAWINGS

Examples of the disclosure are further described hereinafter with reference to the accompanying drawings, in which.

DETAILED DESCRIPTION

Figure 1:
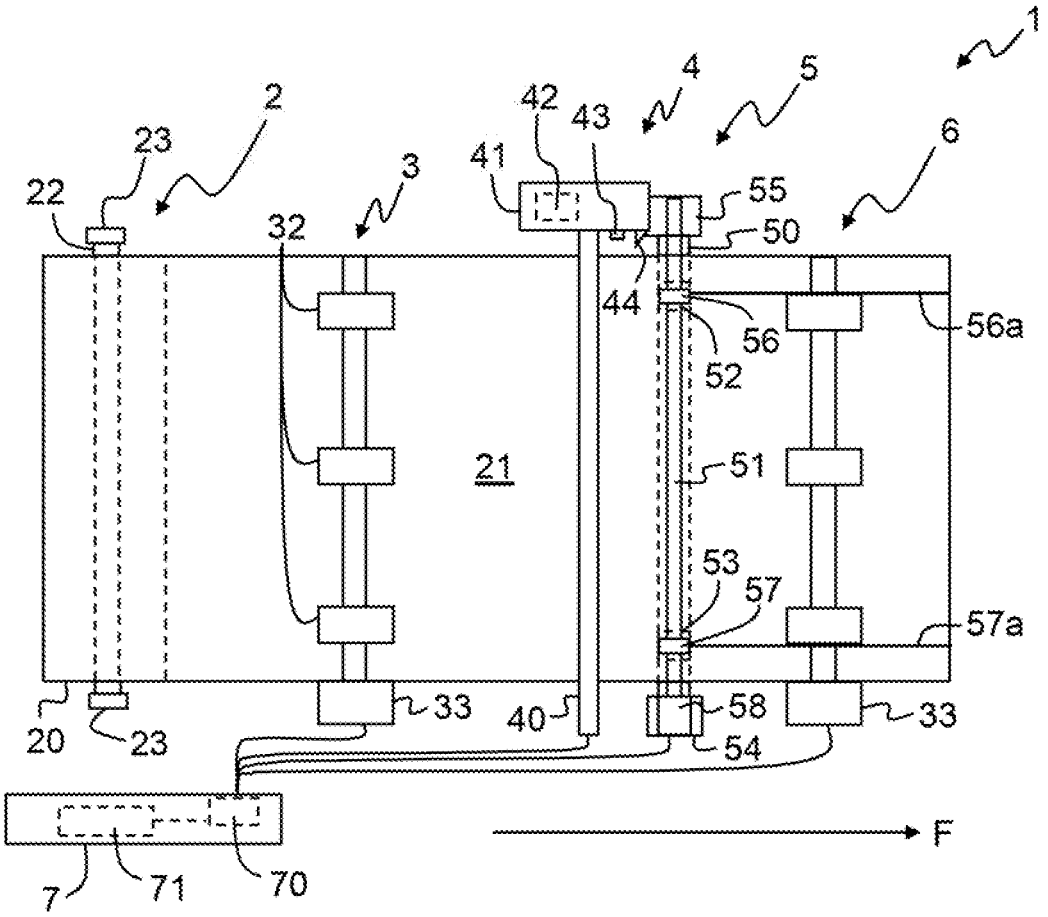
FIG. 1 is top view diagram of an example printing system that may make use of the present disclosure.

Discrepancies between actual and expected cut locations can result from factors and often such discrepancies are the result of these factors being compounded. Manufacturing tolerances in each of the components between the positioning mechanism and the cutting edge of a cutter can create significant variability. Variability can also be caused by the positioning mechanism, for example positioning error or backlash in the drive unit. Variations in the shape, location and orientation of the cutter may also contribute to variability.

The present disclosure relates to the calibration of systems incorporating cutters by comparing actual cut locations with calculated or expected cut positions. Cutters can be positioned based on a virtual coordinate system. This virtual coordinate system may be adjusted based on a deviation between the actual cut location and an expected cut position.

A system is disclosed that comprises at least one cutter, a sensor and a controller coupled to the cutter and to the sensor. The controller comprises a processor, a memory coupled to the processor and an instruction set. Also disclosed is a method that can be used to calibrate the positioning of a cutter in the system.

According to some described examples, a cutter is positioned at a cutting position according to a virtual coordinate system and the cutter cuts through media at the cutting position. The actual location of the cut in the media is then detected and the virtual coordinate system is adjusted based on an offset between the cutting position and the actual cut location. This adjustment can therefore correct for multiple factors contributing to a discrepancy between the cutting position and the actual cut location.

Cutting through media can be achieved by any method, such as moving the cutter across the media in any direction or feeding media in a feeding direction through or across the cutter. Where the media is fed through or across the cutter, for example to create a cut along the feeding direction or Y-direction, the actual location of the cut may be detected by retracting the media in a direction opposite the feeding direction. A further cutter may be provided. The same or the further cutter may move across the media in a direction perpendicular to the feeding direction, for example to create a cut in an X-direction, to separate upstream and downstream portions of the media. In some described examples, this enables a sensor to be used in order to detect the actual location of the cut, for example by detecting an edge of the media created by the cut.

Some described examples relate to cutters included in printing systems. The media may comprise a print target, for example a two dimensional or three dimensional print target. Printing systems generally use standard paper media sizes, which may not be appropriate for some print works. In such cases, it may be desirable to incorporate a cutter in the printing system to trim a margin of the paper media to provide a more appropriate size for the printed work. Cutters of this kind are often positioned manually.

FIG. 1 shows an example printing system 1 incorporating cutters which are positioned and deployed automatically. In this example, the printing system 1 includes a paper media source 2, a first feed mechanism 3, a printing module 4, a cutting station 5 a second feed mechanism 6 and a controller 7.

The paper media source 2 in this example includes a roll 20 of paper media 21 mounted on an axle 22 rotatably supported at each end by a bearing 23. Paper media 21 from the roll 20 is fed in a feeding direction F into a first of the feed mechanisms 3 to the printing module 4, then to the cutting station 5 and finally to a second feed mechanism 6 before it exits the printing system 1. Other arrangements are also envisaged. Reference herein to "upstream" and "downstream" refer to such relative positions in relation to the feed direction F.

Figure 2:
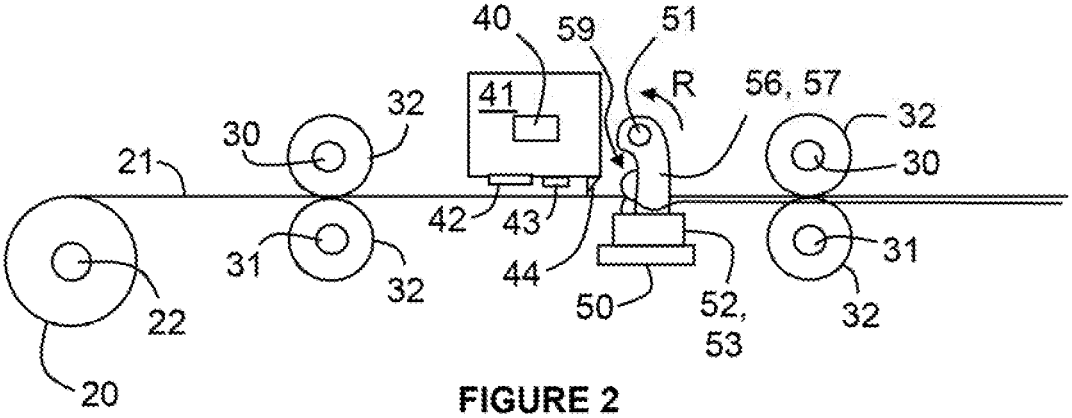
FIG. 2 is a side view diagram of elements of the printing system of FIG. 1.

In this example and as shown more clearly in FIG. 2, each feed mechanism 3, 6 includes an upper shaft 30 and a lower shaft 31 each lying perpendicular to the feed direction F. Each feed mechanism 3, 6 also includes a servo motor 33 to drive the lower shaft 31. Each shaft 30, 31 carries three rollers 32 secured to rotate therewith such that when the drive motor 33 drives the lower shaft 31 paper media 21 received between the upper and lower rollers 32 is made to advance in the feed direction F. Other arrangements are also envisaged.

The printing module 4 according to this example includes a rail 40 lying perpendicular to the feed direction F and a carriage 41 movable along the rail 40. The carriage 41 includes a print head 42, a line sensor 43 and a deployable X-cutter 44 mounted thereto. In this example, the line sensor 43 is an optical sensor but other sensors may be used. In use, the carriage 41 may be moved along the rail 40 as the print head 42 prints on the paper media 21. The carriage 41 may also be moved from one end of the rail 40 to the other with the X-cutter 44 deployed to cut across the paper media 21.

The cutting station 5 in this example includes a lower rail 50 beneath the paper media 21 and an upper rail 51 above the paper media 21, each rail 50, 51 lying perpendicular to the feed direction F. A pair of carriages 52, 53 are mounted to the lower rail 50 and driven therealong by a respective servo motor 54, 55 via a drive belt (not shown). A pair of Y-cutters 56, 57 are mounted to the upper rail 51 such they are slidable therealong but secured to rotate therewith. The upper rail 51 is rotatable about its axis by a servo motor 58 to move the Y-cutters 56, 57 simultaneously between a deployed condition, shown in FIG. 2, and a retracted condition in which the Y-cutters 56, 57 are rotated in a retraction direction R. The Y-cutters 56, 57 in this example include a pair of opposed rotary cutting blades 59. One of the cutting blades 59 lies at an angle with respect to the feeding direction in order to ensure a single point of contact between the blades 59 and the paper media 21.

In use, paper media 21 may be fed through the cutting station 5 with the Y-cutters 56, 57 in the deployed condition to create Y-cuts 56*a*, 57*a*. If a single Y-cut 56*a*, 57*a* is desired, one of the Y-cutters 56, 57 may be positioned outside of the width of the paper media 21 as the paper media 21 is fed through the cutting station 5. If no Y-cuts 56*a*, 57*a* are desired both Y-cutters 56, 57 may be positioned outside of the width of the paper media 21 or kept in their retracted condition as the paper media 21 is fed through the cutting station 5.

Each carriage 52, 53 in this example is U-shaped in plan to allow the Y-cutters 57 to be rotated in into and out of registration therewith. When the Y-cutters 56, 57 are engaged with their respective carriage 52, 53, the carriage 52, 53 can be moved along the lower rail 50 to reposition the Y-cutter 56, 57 to a desired position, referred to herein as a cutting position. When the Y-cutters 56, 57 are retracted, paper media 21 is able to pass through the cutting station 5 without being cut.

The printing module 4 and cutting station 6, and particularly the X-cutter 44 and Y-cutters 56, 57, may take other forms. For example, the X-cutter 44 may be included in the cutting station 5 and/or the Y-cutters 56, 57 may cut along both the feeding direction F and a direction perpendicular thereto.

The controller 7 includes a processor 70 and a memory 71 coupled to the processor. The controller 7 is coupled to each of the feed mechanisms 3, 6, the printing module 4 and cutting station 5 to enable them to be controlled by the processor 70. The position of the Y-cutters 56, 57 is controlled according to a virtual coordinate system which, in this example, is a one-dimensional number line. The memory 71 includes a set of instructions stored thereon to calibrate the position of the Y-cutters 56, 57.

Figure 3:
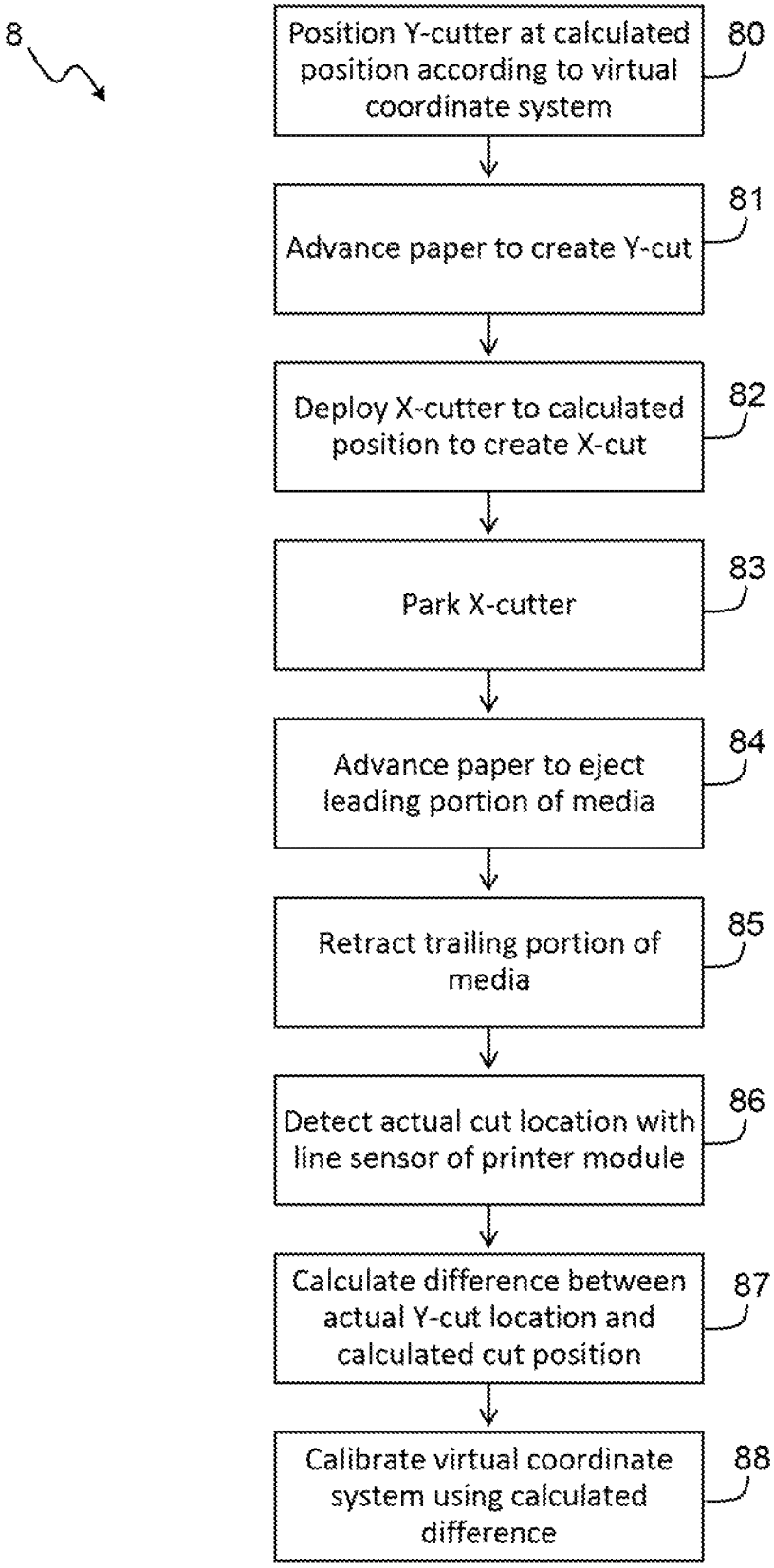
FIG. 3 is an example flowchart of a routine which may be used to calibrate a cutter of the printing system of FIGS. 1 and 2.

In this example, the instructions cause the processor 70 to control the system to carry out a process 8 as outlined in the flow chart shown in FIG. 3. More particularly, a first Y-cutter 56 is positioned 80 at a cutting position according to the virtual coordinate system. The paper media 21 is then advanced 81 to create a Y-cut 56*a*, after which the X-cutter 44 is deployed 82 to a position slightly beyond the cutting position to create an X-cut 44*a*.

Figure 4:
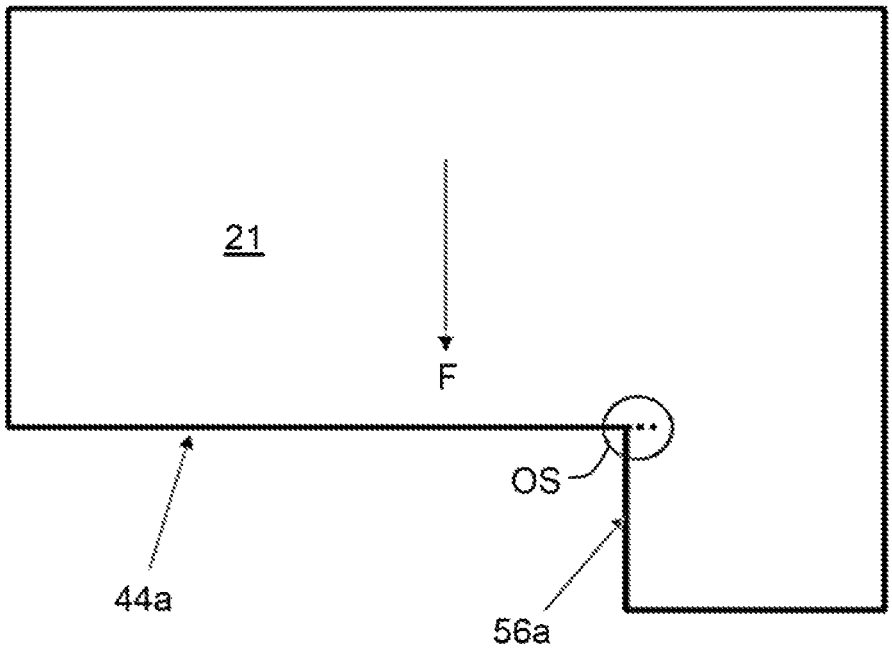
FIG. 4 is a diagram of an example cut sequence used in implementing the routine of FIG. 3.

Thus, the paper media 21 is separated into a leading portion and a trailing portion. The trailing portion of the paper media 21, upstream of the X-cut 44*a*, is illustrated in FIG. 4 in which the overshoot OS of the X-cut 44*a* can be seen. The X-cutter 44 is then parked 83 and the paper media 21 is advanced 84 to eject the leading portion of the paper media 21, downstream of the X-cut 44*a*.

The trailing portion of the paper media 21 then retracted 85 and the actual location of the edge created by the V-cut 56*a* is, detected 86 by the line sensor 43 of the printing module 4. The difference between the actual location detected by the line sensor 43 and the cutting position is calculated 87 and the virtual coordinate system is calibrated 88 based on this difference.

The calibration procedure may then be repeated for second Y-cutter 57. In other examples, the system 1 may include three or more V-cutters and each may be calibrated using the aforementioned procedure.

Figure 5:
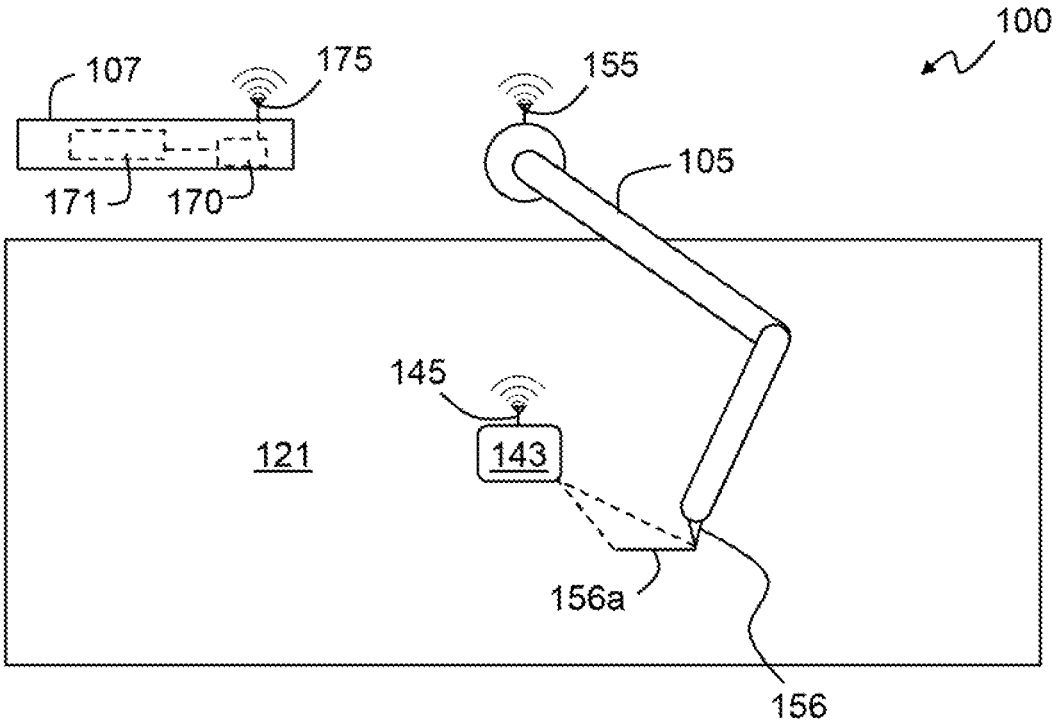
FIG. 5 is top view diagram of an example cutting system that may make use of the present disclosure.

FIG. 5 shows an example system 100 including a cutter 156 mounted to the end of a robotic arm 105, a sensor 143 and a controller 107. Each of the robotic arm 105, the sensor 143 and the controller 107 includes a respective wireless transceiver 155, 145, 175 to enable the controller 107 to control the robotic arm 105 and to receive data from the sensor 143. In this example, the sensor 143 is in the form of a vision camera mounted above media 121 to be cut to capture image data including data indicative of the position of a cut 156*a* made by the cutter 156.

The controller 107 includes a processor 170 and a memory 171 coupled to the processor. The position of the cutter 156 is controlled according to a virtual coordinate system which, in this example, is three-dimensional. The memory 171 includes a set of instructions stored thereon to calibrate the position of the cutter 156.

Figure 6:
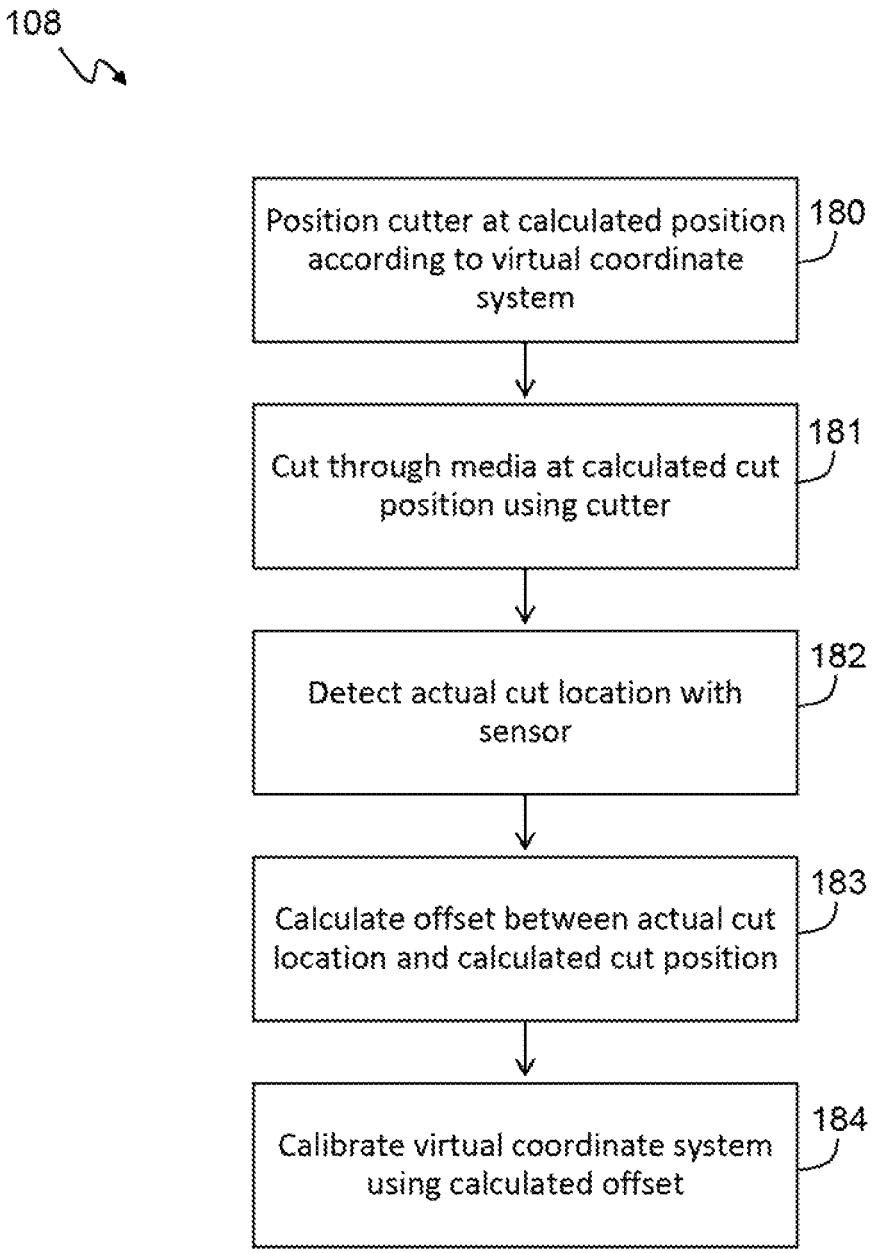
FIG. 6 is an example flowchart of a routine which may be used to calibrate a cutter of a printing system.

In this example, the instructions cause the processor 170 to control the system 100 to carry out a process 108 as outlined in the flow chart shown in FIG. 6. More particularly, the cutter 156 is positioned 180 at a cutting position according to the virtual coordinate system and the media 121 is then cut 181 using the cutter 156 to form a cut 156*a*. The actual location of the cut 156*a* is then detected 182 by the sensor 143 and an offset between the actual location of the cut 156*a* and the cutting position is calculated 183, which offset may be in up to three dimensions. The virtual coordinate system is then calibrated 184 using the calculated offset.

Throughout the description and claims of this specification, the words "comprise" and "contain" and variations of them mean "including but not limited to", and they are not intended to (and do not) exclude other moieties, additives, components or integers. Throughout the description and claims of this specification, the singular encompasses the plural unless such interpretation is inappropriate. In particular, where the indefinite article is used, the specification is to be understood as contemplating plurality as well as singularity, unless such interpretation is inappropriate.

In examples, the printing system 1 may comprise an inkjet printing system, a Xerography printing system or a liquid electrophotography printing system. In examples, the memory 71, 171 includes a Non-Volatile Memory (NVM) or other non-transitory computer readable medium. In examples, different functions of the control of the aforementioned systems 1, 100 may be embodied in, or hosted in, different controllers or control modules, which may be standalone controllers or control modules or they may be associated with other features or subsystems, for example the feed mechanisms 3, 6, printing module 4 and/or cutting station 5 of the printing system 1.

Features, integers, characteristics or groups described in conjunction with a particular aspect or example of the present disclosure are to be understood to be applicable to any other aspect or example, described herein unless incompatible therewith. All of the features disclosed in this specification (including any accompanying claims, abstract and drawings), and/or any method or process so disclosed, may be combined in any combination, except combinations where at least some of such features are mutually exclusive.

The invention claimed is:

1. A method comprising:

positioning a cutter at a cutting position;

feeding media in a feeding direction;

as the media is fed, cutting through the media at the cutting position using the cutter to create a cut along the feeding direction;

cutting the media in a direction perpendicular to the feeding direction to separate a leading portion of the media from a trailing portion of the media along the feeding direction;

retracting the trailing portion of the media in a direction opposite the feeding direction without retracting the leading portion;

after the retracting of the trailing portion, detecting an actual location of the cut in the media along the feeding direction; and calibrating the cutter based on an offset between the cutting position and the actual location of the cut.

2. The method according to claim 1, wherein feeding the media in the feeding direction comprises feeding the media in the feeding direction through or across the cutter, resulting in the cutter creating the cut along the feeding direction as the media is fed.

3. The method according to claim 1, wherein detecting the actual location of the cut comprises detecting, using a sensor, an edge in the trailing portion created by the cut.

4. The method according to claim 3, wherein the sensor is a line sensor of a printing module located upstream of the cutter.

5. The method according to claim 1, wherein positioning the cutter at the cutting position comprises moving the cutter along an axis perpendicular to the feeding direction.

6. A system comprising:

first and second cutters;

a motor;

a sensor;

a processor; and a memory storing an instruction set executable by the processor to:

cause the first cutter to move to a cutting position;

cause the motor to feed media in a feeding direction;

cause the first cutter to cut through the media at the cutting position to create a cut along the feeding direction as the media is fed;

cause the second cutter to cut the media in a direction perpendicular to the feeding direction to separate a leading portion of the media from a trailing portion of the media along the feeding direction;

cause the motor to retract the trailing portion of the media in a direction opposite the feeding direction without retracting the leading portion;

after causing the motor to retract the trailing portion, determine an actual location of the cut from data received from the sensor; and calibrate the first cutter based on an offset between the cutting position and the actual location of the cut along the feeding direction as detected by the sensor.

7. The system according to claim 6, wherein the first cutter is movable along an axis perpendicular to the feeding direction.

8. The system according to claim 7, further comprising:

a carriage driven by a servo motor to engage and move the first cutter along the axis.

9. The system according to claim 6, wherein the sensor is to detect the actual location of the cut along the feeding direction by detecting an edge in the trailing portion created by the cut.

10. The system according to claim 6, further comprising:

a printing module, including the sensor, upstream of the first cutter.

11. A non-transitory machine-readable storage medium encoded with instructions executable by a processor to perform processing, the instructions comprising:

causing a first cutter to move to a cutting position;

causing a motor to feed media in a feeding direction;

causing the first cutter to cut through the media at the cutting position to create a cut along the feeding direction as the media is fed;

causing a second cutter to cut the media in a direction perpendicular to the feeding direction to separate a leading portion of the media from a trailing portion of the media along the feeding direction;

causing the motor to retract the trailing portion of the media in a direction opposite the feeding direction without retracting the leading portion;

after causing the motor to retract the trailing portion, determining an actual location of the cut in the media from data received from a sensor; and calibrating the first cutter based on an offset between the cutting position and the actual location of the cut along the feeding direction as detected by the sensor.

* * * * *